US010190778B2

(12) United States Patent
Emiliani

(10) Patent No.: US 10,190,778 B2
(45) Date of Patent: Jan. 29, 2019

(54) COOKING HOB GAS BURNER

(71) Applicant: DEFENDI ITALY S.R.L., Camerano (IT)

(72) Inventor: Girolamo Emiliani, Camerano (IT)

( * ) Notice: Subject to any disclaimer, the term of this patent is extended or adjusted under 35 U.S.C. 154(b) by 0 days.

(21) Appl. No.: 15/110,615

(22) PCT Filed: Jan. 12, 2015

(86) PCT No.: PCT/IB2015/050222

§ 371 (c)(1),
(2) Date: Jul. 8, 2016

(87) PCT Pub. No.: WO2015/107446

PCT Pub. Date: Jul. 23, 2015

(65) Prior Publication Data

US 2016/0341430 A1 Nov. 24, 2016

(30) Foreign Application Priority Data

Jan. 14, 2014 (IT) ..... VE2014A0002

(51) Int. Cl.
*F24C 3/08* (2006.01)
*F23D 14/06* (2006.01)
*F23D 14/26* (2006.01)

(52) U.S. Cl.
CPC ..... *F24C 3/08* (2013.01); *F23D 14/06* (2013.01); *F23D 14/26* (2013.01); *F23D 2203/00* (2013.01); *F23D 2900/14062* (2013.01)

(58) Field of Classification Search
CPC .. F24C 3/08; F24C 3/082; F24C 3/085; F23D 2900/14062
See application file for complete search history.

(56) References Cited

U.S. PATENT DOCUMENTS 3,625,196 A * 12/1971 Craver ..... F24C 3/085 126/214 R
3,627,462 A * 12/1971 Lotter ..... F23D 14/06 239/104

(Continued)

FOREIGN PATENT DOCUMENTS

GB 2100411 12/1982
GB 2272283 5/1994

(Continued)

OTHER PUBLICATIONS

Machine translation of Kazuyuki JP2008202866, "JP2008202866 wipo translate.pdf." attached.*

*Primary Examiner* — Avinash A Savani
*Assistant Examiner* — Martha M Becton
(74) *Attorney, Agent, or Firm* — Themis Law

(57) ABSTRACT

A gas burner includes an injector holder fixable to the sheet metal of a cooking hob and provided on its base with an injector, a burner body associated with the injector holder and defining with the sheet metal a circumferential passage for the entry of primary air intended to form the combustion mixture with the gas leaving the injector, at least one cover, formed from a single piece of drawn sheet metal, positioned on the burner body and defining therewith at least one radial venturi effect chamber, wherein the cover includes a circumferential flange provided with a plurality of elongated apertures of essentially vertical extension, for passage of the combustion mixture which generates a ring of main flames.

11 Claims, 2 Drawing Sheets

(56) References Cited

U.S. PATENT DOCUMENTS

Figure 1:
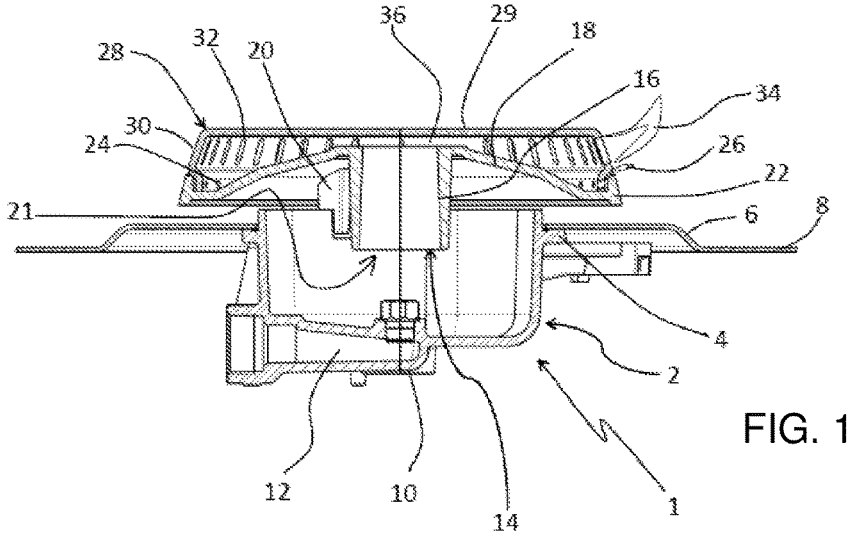

| | | | | |
|---|---|---|---|---|
| 3,809,055 | A * | 5/1974 | Craver | F24C 3/085 126/214 R |
| 6,322,354 | B1 * | 11/2001 | Carbone | F23D 14/02 126/39 E |
| 6,332,460 | B1 * | 12/2001 | Paesani | F23D 14/06 126/39 R |
| 8,845,326 | B2 * | 9/2014 | Shaffer | F23D 14/06 126/39 E |
| 2003/0039935 | A1 * | 2/2003 | Harneit | F23D 14/06 431/266 |
| 2014/0116417 | A1 * | 5/2014 | Dora | F23D 14/56 126/39 E |
| 2016/0201902 | A1 * | 7/2016 | Cadima | F24C 3/085 126/39 E |
| 2016/0327277 | A1 * | 11/2016 | Emiliani | F23D 14/06 |

FOREIGN PATENT DOCUMENTS

| | | | |
|---|---|---|---|
| JP | 2008202866 | | 9/2008 |
| WO | WO2007068659 | A1 * | 6/2007 |

* cited by examiner

COOKING HOB GAS BURNER

The present invention relates to an improved gas burner.

Gas burners are known intended to be installed in particular in cooking hobs. They comprise an injector holder cup, a burner body positioned on the injector holder cup and a cover positioned on the burner body and defining therewith a chamber for mixing the gas with the primary air and distributing the hence formed mixture, to feed a flame ring.

The injector holder cup is made of die-cast aluminium and is provided on its circumference with means for its fixing to the sheet metal of the cooking hob and on its base with an injector of vertical axis connected to the gas intake conduit.

The burner body is also made of die-cast aluminium and is provided with a conduit of vertical axis coaxial with the injector, which faces this latter at its lower end and opens at its upper end into the distribution chamber, bounded upperly by the cover. In its outer edge there is provided a plurality of primary and secondary apertures, which generate the ring of main flames and the stabilization flame.

The cover can be of two types: the first type has its outer surface virtually flat and is of more pleasant appearance and easier to clean; the second type has its upper surface provided centrally with a depression or projection, which makes it of less pleasant appearance and less easy to clean; at the same time it can be made of sheet metal of lesser thickness and is hence less costly than the first type.

A compromise tending to reconcile both these requirements is widely available for example in Brazil, where cost represents the most important factor; in this case the closure cover is made from a single piece of sheet metal and includes the holes for forming the ring of main flames, in this manner forming a true flame divider. In contrast, in such known flame dividers the apertures for generating the ring of main flames consist of more or less large holes which, besides being of unpleasant appearance, present technical limitations. In particular, because of the thin sheet metal with which the flame divider is made, when liquefied gas is used, passage from the maximum flow position to the minimum flow or closed position can cause a small detonation. This means that the burner minimum flow rate has necessarily to be increased, with consequent reduction of its operating range.

The object of the invention is to eliminate the aforesaid drawbacks by providing a gas burner for cooking hobs with a sheet metal cover which is able to generate an upwardly generated flame ring.

This and other objects which will be apparent from the ensuing description are attained according to the invention by an improved gas burner presenting the characteristics described in claim 1.

Figure 2:
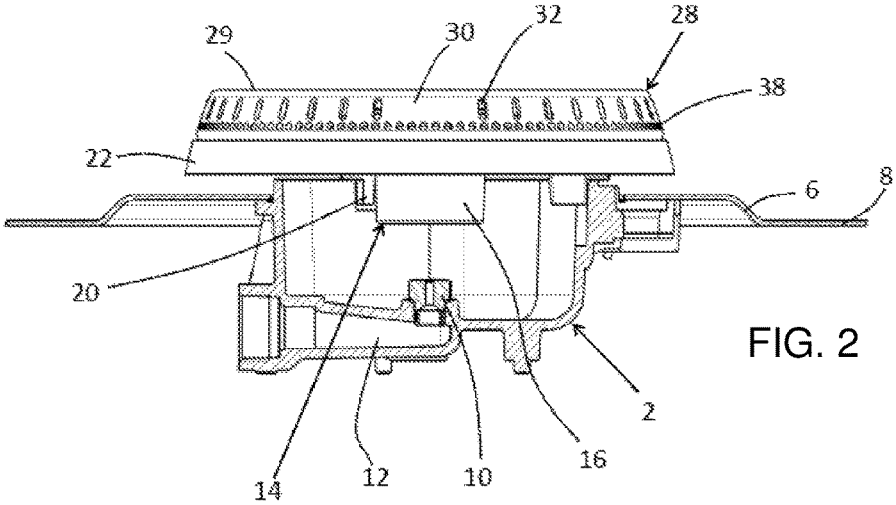
Figure 3:
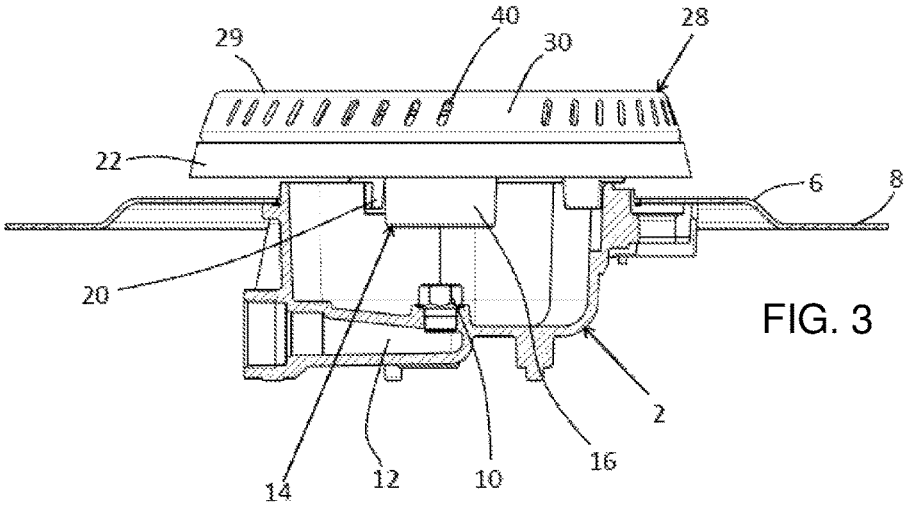
Figure 4:
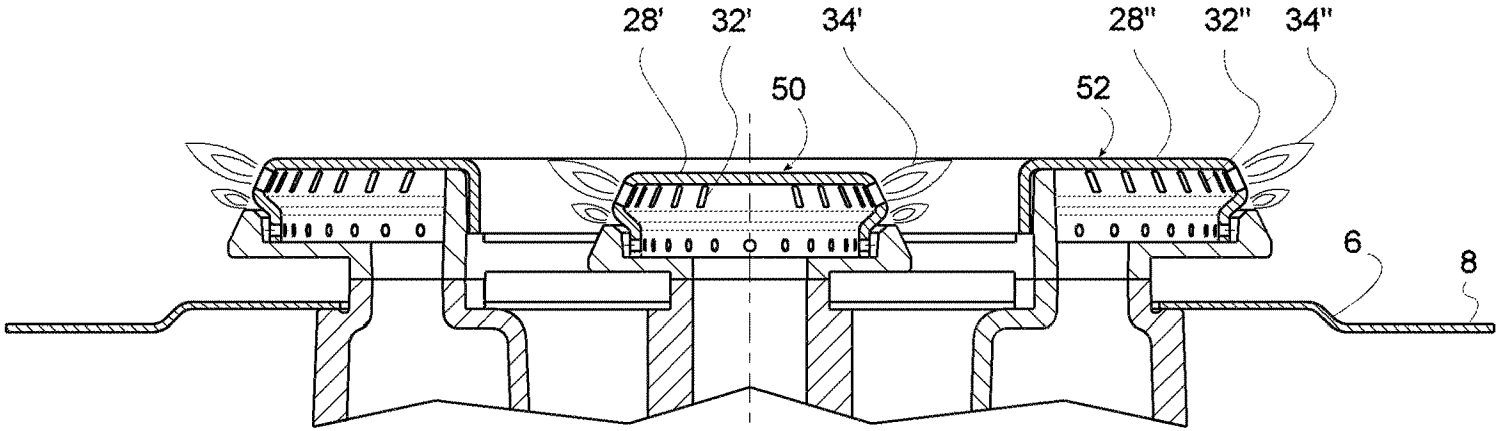

The present invention is further clarified hereinafter in the form of three preferred embodiments, with reference to the accompanying drawings, in which:

FIG. 1 is a diametrical section through a first embodiment of a gas burner according to the invention, FIG. 2 is a lateral view of a second embodiment thereof shown partly sectioned at the cup-shaped support, and FIG. 3 is a partly sectioned lateral view of a third embodiment thereof.

In the embodiment of FIG. 1, the burner according to the invention comprises a cup-shaped support 2, provided with a circumferential flange 4 by which the support can be fixed in traditional manner to an annular projection 6, formed in the upper sheet metal 8 of a cooking hob.

On the base of the cup-shaped support 2 a seat is provided for an injector 10 of vertical axis, fed with the gas via a conduit 12 provided in the support.

A burner body 14 rests on the cup-shaped support 2. It comprises a substantially cylindrical tubular portion 16, coaxial with the injector 10 and having its lower end facing it and its upper end opening at the centre of a circular portion 18 with downwardly-facing slight concavity.

From the lower surface of this circular portion 18, three shoulders 20 extend downwards disposed at 120° apart and forming elements for supporting the burner body 14 at the circumferential edge of the cup-shaped support 2.

The dimensioning of the various parts is such that when the burner body 14 rests on the cup-shaped support 2, the circumferential edge of the circular portion 18 defines with the cooking hob 8 an annular passage through which the primary air 21 required for forming the combustible mixture with the gas, can enter the interior of the cup-shaped support 2.

The circumferential edge of the circular portion 18 faces upwards and forms an annular band 22.

The burner according to the invention also comprises a cover 28 which is rested on the burner body 14. In particular, the cover 28 can rest with its lower edge on the inner zone (defined externally by the annular band 22) of the upper surface of said circular portion 18 (see FIG. 1) and/or can rest on the upper edge of the annular band 22 (see FIG. 2).

The cover 28 is made of blanked and drawn sheet metal, preferably of steel, but also of aluminium, brass, stainless steel, sintered steel or other suitable metal alloys.

The cover 28 has an essentially flat upper surface 29, with the edge bent downwards to form externally a circumferential band 30 provided with a plurality of apertures 32 of essentially elongated vertical extension, for passage of the combustion mixture which generates the ring of main flames 34.

The cover 28 has a radial extension less than that of the annular band 22 of the body 14. Preferably, the annular band 22 of the burner body 14 is exposed (i.e. is not covered/hidden by the cover 28) and is inclined by an angle corresponding to the inclination of the circumferential flange 30 of the cover 28, such as to define line continuity between said cover and the exposed portion of the burner body 14. However, it should be noted that said annular band 22 of the burner body 14 can also present an inclination which is different from that of the circumferential flange 30 of the cover 28.

The substantially flat portion 29 of the cover 28 defines with the concave portion 18 of the burner body 14 a radial venturi effect chamber 36, which facilitates the mixing of the gas with the primary air and the formation of the combustion mixture.

In a position underlying the elongated apertures, the circumferential flange 30 of the cover 28 is provided with a plurality of small apertures 24 for passage of the combustion mixture intended to feed an annular stabilization flame 26 for the ring of main flames 34. In particular, the small apertures 24 of the circumferential flange 30 of the cover 28 are covered and hidden by the annular band 22 of the burner body; hence the mixture which leaves the apertures 24 of the cover 28 generates the annular stabilization flame 26 at holes (not shown) provided in the annular band 22 of the burner body 14, or in that annular space left between the lower edge of the cover 28 and the upper edge of the annular band 22 of the body 14 (see FIG. 1).

In greater detail, the sheet metal which forms the cover 28 has a thickness preferably between 1.0 and 1.7 mm, while the elongated apertures 32 provided in the circumferential band 30 have a height between 3.0 and 7.0 mm and a width between 1.0 and 1.7 mm.

The elongate shape of these apertures 32 has proved considerably advantageous, in that:

it enables the main flames 34 to be given a direction with a strong vertical component, ensuring burner efficiency while enabling a low minimum power thereof and hence a wide range of burner operation, it enables this advantage to be achieved while using a cover 28 of small thickness, it substantially reduces the risk of returning flame, it eliminates small explosion phenomena when the gas feed is shut off, particularly of liquefied gas.

In a second embodiment shown in FIG. 2, both the elongated apertures 32 for the ring of main flames 34, and the small apertures 38 for the ring of stabilization flames 26 are provided in the inclined circumferential band 30 of the cover 28, very close together. In particular, in this second embodiment, the small apertures 38 are not covered by the annular band 22 of the body 14, hence the stabilization flames 26 are generated at these apertures.

In a third embodiment shown in FIG. 3, in contrast to the burners of the two previous embodiments which have the axes of the elongated apertures 32 lying in a radial vertical plane, this embodiment provides elongated apertures 40 with their axis inclined to said radial vertical planes.

A cover/flame divider 28 with apertures 32 or 40 of elongated vertical extension (and with one or more of the aforedescribed characteristics) can also be used with multi-ring burners, i.e. with burners presenting a central body 50, from which a central flame ring originates, and an annular body 52, which is separated from said central body by an annular cavity 53 and in which one or more annular flame rings originate, concentric to said central ring.

In particular, in such burner the cover 28 comprises:

a first cover 28' that has elongated apertures 32' of essentially vertical extension and that defines, with the central portion 50 of the burner body 14, a central chamber from which the first ring of main flames 34' emerges through the elongated apertures 32', and a second cover (28") that has elongated apertures 32" of essentially vertical extension and that defines, with the annular portion 52 of the burner body 14, an annular chamber from which the second ring of main flames 34" emerges through said elongated apertures 32".

Preferably, the first cover 28' is of circular shape while the second cover 28" is of annular shape.

The invention claimed is:

1. An improved gas burner, comprising:

an injector holder (2) configured to be fixed to a sheet metal (8) of a cooking hob, the injection holder being provided on its base with an injector (10);

a burner body (14) resting on said injector holder (2), a circumferential passage being defined between said burner body and said injection holder for entry of primary air intended to form a combustion mixture with gas leaving said injector (10); and a cover (28), formed from a single piece of drawn sheet metal, positioned on said burner body (14), wherein said cover comprises a first circumferential flange (30) provided with a plurality of elongated apertures (32, 40) of essentially vertical extension, for passage of the combustion mixture which generates a ring of main flames (34), wherein a radial venturi effect chamber (36) is defined in an interspace between said cover and an upper surface of said burner body, said radial venturi effect chamber having a wider end facing said elongated apertures, wherein said burner body further comprises an annular band (22) extending upwardly from an outer circumferential edge of said burner body, wherein a second circumferential flange extends downward from said first circumferential flange toward said burner body, said first circumferential flange extending radially more than said second circumferential flange so that the second circumferential flange is concentric to, and radially interior to, the annular band, and wherein a plurality of first small apertures (24) are defined in said second circumferential flange for the passage of the combustion mixture to feed an annular stabilization flame (26) for the ring of main flames, said first small apertures being positioned axially below a lower surface of said first circumferential flange, whereby said annular stabilization flame is formed in an annular space defined by said lower surface of said first circumferential flange, said second circumferential flange, and said annular band, and whereby said plurality of first small apertures is hidden from view by said annular band.

2. The gas burner as claimed in claim 1, wherein the sheet metal which forms the cover has a thickness between 1.0 and 1.7 mm.

3. The gas burner as claimed in claim 1, wherein said elongated apertures (32, 40) have a height between 3.0 and 7.0 mm and a width between 1.0 and 1.7 mm.

4. The gas burner as claimed in claim 1, wherein a surface of said circumferential flange (30) is inclined in relation to a vertical axis.

5. The gas burner as claimed in claim 1, wherein said annular band (22) of the burner body (14) is exposed and is inclined by an angle corresponding to an inclination of the circumferential flange (30) of said cover (28), such as to define line continuity between said cover (28) and an exposed portion of said body (14).

6. The gas burner as claimed in claim 1, wherein said cover (28) has a radial length less than a radial length of the annular band (22) of the burner body (14).

7. The gas burner as claimed in claim 1, wherein said elongated apertures (32) have axes lying in radial vertical planes of the gas burner.

8. The gas burner as claim 1, wherein said elongated apertures (40) have axes inclined to radial vertical planes of the gas burner.

9. The gas burner as claimed in claim 1, wherein said cover (28) comprises an essentially flat upper surface (29) with an edge bent downwards to form said circumferential flange (30).

10. The gas burner as claimed in claim 1, wherein:

said burner body (14) comprises a central portion and an annular portion which is concentric to the central portion and is separated therefrom by an annular cavity, wherein said cover comprises a first cover and a second cover, and said ring of main flames comprises a first ring of main flames and a second ring of main flames, wherein said first cover defines, with said central portion of the burner body (14), a central chamber from which the first ring of main flames emerges through said elongated apertures (32) of essentially vertical extension of said cover (28), and wherein said second cover defines, with said annular portion of said body (14), an annular chamber from which the second ring of main flames emerges through said elongated apertures (32) of essentially vertical extension of said at least one cover (28).

11. The gas burner as claimed in claim 10, wherein said cover (28) comprises:

said first cover is of circular shape and, with said central portion of said body (14), defines said central chamber, and said second cover is of annular shape and, with said annular portion of said body (14), defines said annular chamber.

* * * * *